US010208618B2

(12) United States Patent
Gasmen et al.

(10) Patent No.: US 10,208,618 B2
(45) Date of Patent: Feb. 19, 2019

(54) VANE ARM HAVING A CLAW

(71) Applicant: UNITED TECHNOLOGIES CORPORATION, Hartford, CT (US)

(72) Inventors: Eugene C. Gasmen, Rocky Hill, CT (US); Bernard W. Pudvah, Portland, CT (US); Stanley Wiecko, Newington, CT (US)

(73) Assignee: United Technologies Corporation, Farmington, CT (US)

( * ) Notice: Subject to any disclaimer, the term of this patent is extended or adjusted under 35 U.S.C. 154(b) by 587 days.

(21) Appl. No.: 14/167,382

(22) Filed: Jan. 29, 2014

(65) Prior Publication Data

US 2014/0219785 A1 Aug. 7, 2014

Related U.S. Application Data

(60) Provisional application No. 61/836,832, filed on Jun. 19, 2013, provisional application No. 61/760,232, filed on Feb. 4, 2013.

(51) Int. Cl.

| | |
|---|---|
| ***F01D 17/14*** | (2006.01) |
| ***F01D 17/16*** | (2006.01) |
| ***F04D 29/56*** | (2006.01) |

(52) U.S. Cl.

CPC ..... *F01D 17/14* (2013.01); *F01D 17/162* (2013.01); *F04D 29/563* (2013.01); *Y10T 29/49316* (2015.01); *Y10T 29/49321* (2015.01)

(58) Field of Classification Search

CPC ..... F01D 17/14; F01D 17/16; F01D 17/162; F04D 29/563

See application file for complete search history.

(56) References Cited

U.S. PATENT DOCUMENTS

| | | | | |
|---|---|---|---|---|
| 5,205,708 | A * | 4/1993 | Plemmons | F01D 11/08 29/446 |
| 5,492,446 | A * | 2/1996 | Hawkins | F01D 17/162 411/116 |
| 6,314,739 | B1 * | 11/2001 | Howell | F01D 11/005 60/748 |
| 6,799,945 | B2 * | 10/2004 | Chatel | F01D 17/162 415/156 |
| 7,011,494 | B2 * | 3/2006 | Kies | F01D 17/162 415/148 |
| 7,448,848 | B2 | 11/2008 | Alexander et al. | |
| 2004/0115045 | A1 * | 6/2004 | Alexander | F01D 17/162 415/165 |
| 2004/0146398 | A1 * | 7/2004 | Bromann | F01D 17/162 415/148 |
| 2010/0092278 | A1 * | 4/2010 | Major | F01D 17/162 415/160 |
| 2010/0166540 | A1 | 7/2010 | Perez et al. | |
| 2012/0251297 | A1 | 10/2012 | Major et al. | |

* cited by examiner

*Primary Examiner* — Jason Shanske
*Assistant Examiner* — Maxime Adjagbe
(74) *Attorney, Agent, or Firm* — Carlson, Gaskey & Olds, P.C.

(57) ABSTRACT

An exemplary variable vane actuation system for a gas turbine engine includes a vane arm attachable to a vane stem and configured to rotate the vane stem about a radially extending axis. The vane arm includes a claw feature to be press-fit onto the vane stem.

19 Claims, 5 Drawing Sheets

VANE ARM HAVING A CLAW

CROSS-REFERENCE TO RELATED APPLICATIONS

This application claims priority to U.S. Provisional Application Nos. 61/760,232, which was filed on 4 Feb. 2013, and 61/836,832, which was filed on 19 Jun. 2013. Both of the applications are incorporated herein by reference.

BACKGROUND

This disclosure relates to a vane arm for a variable vane actuation system of a gas turbine engine and, more particularly, a claw of the vane arm.

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Vanes are provided between rotating blades in the compressor and turbine sections. Moreover, vanes are also provided in the fan section. In some instances the vanes are movable to tailor flows to engine operating conditions. Variable vanes are mounted about a pivot and are attached to an arm that is in turn actuated to adjust each of the vanes of a stage. A specific orientation between the arm and vane is required to assure that each vane in a stage is adjusted as desired to provide the desired engine operation. Accordingly, the connection of the vane arm to the actuator and to the vane is provided with features that assure a proper connection and orientation.

SUMMARY

A variable vane actuation system for a gas turbine engine according to an exemplary aspect of the present disclosure includes a vane arm attachable to a vane stem and configured to rotate the vane stem about a radially extending axis. The vane arm includes a claw feature to be press-fit onto the vane stem.

In a further non-limiting embodiment of the foregoing variable vane actuation system, the claw feature is to be press-fit radially onto the vane stem.

In a further non-limiting embodiment of any of the foregoing variable vane actuation systems, the vane arm includes a D-shaped opening corresponding with a D-shaped portion of the vane stem.

In a further non-limiting embodiment of any of the foregoing variable vane actuation systems, a tab washer is assembled onto the D-shaped threaded portion of the vane stem to bend over an end of the vane arm.

In a further non-limiting embodiment of any of the foregoing variable vane actuation systems, a threaded lock nut is attached to a D-shaped portion of the vane stem to hold the vane arm to the vane stem.

In a further non-limiting embodiment of any of the foregoing variable vane actuation systems, the claw feature has an interference fit to the vane stem that is from 0.002 inches to 0.006 inches.

In a further non-limiting embodiment of any of the foregoing variable vane actuation systems, the claw feature includes fingers terminating at faces spaced from each other to define an opening that receives the vane stem, the faces to interface directly with opposing sides of the vane stem.

In a further non-limiting embodiment of any of the foregoing variable vane actuation systems, a distance between the faces prior to receiving the vane stem is less than a distance between the faces after receiving the vane stem.

In a further non-limiting embodiment of any of the foregoing variable vane actuation systems, a portion of the vane stem extends radially though an opening in the vane stem.

In a further non-limiting embodiment of any of the foregoing variable vane actuation systems, a pin couples an end of the vane arm to an actuation ring, the end opposite the claw feature, the pin is assembled radially to the actuation ring.

In a further non-limiting embodiment of any of the foregoing variable vane actuation systems, attachment of claw feature to the vane stem limits radially outward movement of the pin.

In a further non-limiting embodiment of any of the foregoing variable vane actuation systems, the pin is swaged to connect the pin to the vane arm.

A method of assembling a variable vane actuation system according to another exemplary aspect of the present disclosure includes, among other things, press-fitting a claw feature of a vane arm onto a vane stem.

In a further non-limiting embodiment of the foregoing method of assembling a variable vane actuation system, the method includes press-fitting the claw feature radially on the vane stem.

In a further non-limiting embodiment of any of the foregoing methods of assembling a variable vane actuation system, the claw feature includes fingers terminating at faces spaced from each other to define an opening that receives the vane stem after the press-fitting, and a distance between the faces prior to the press-fitting is less than a distance between the faces after the press-fitting.

In a further non-limiting embodiment of the foregoing method of assembling a variable vane actuation system, the method includes moving an end of the vane arm radially to move the end between an uncoupled position with an actuation ring and a coupled position with the actuation ring, the end opposite the claw feature.

In a further non-limiting embodiment of the foregoing method of assembling a variable vane actuation system, the method includes limiting radial outward movement of the end from the coupled position to the uncoupled position using, exclusively, attachment of the claw feature to the vane stem.

A method of coupling a vane arm within a gas turbine engine according to yet another exemplary aspect of the present disclosure includes, among other things, moving a vane arm radially from an uninstalled position to an installed position within a gas turbine engine.

In a further non-limiting embodiment of the foregoing method of assembling a variable vane actuation system, the method includes press-fitting a claw portion of the vane arm over a vane stem during the moving.

In a further non-limiting embodiment of the foregoing method of assembling a variable vane actuation system, the method includes receiving a portion of a vane stem within an aperture of the vane arm during the moving.

DETAILED DESCRIPTION

Figure 1:
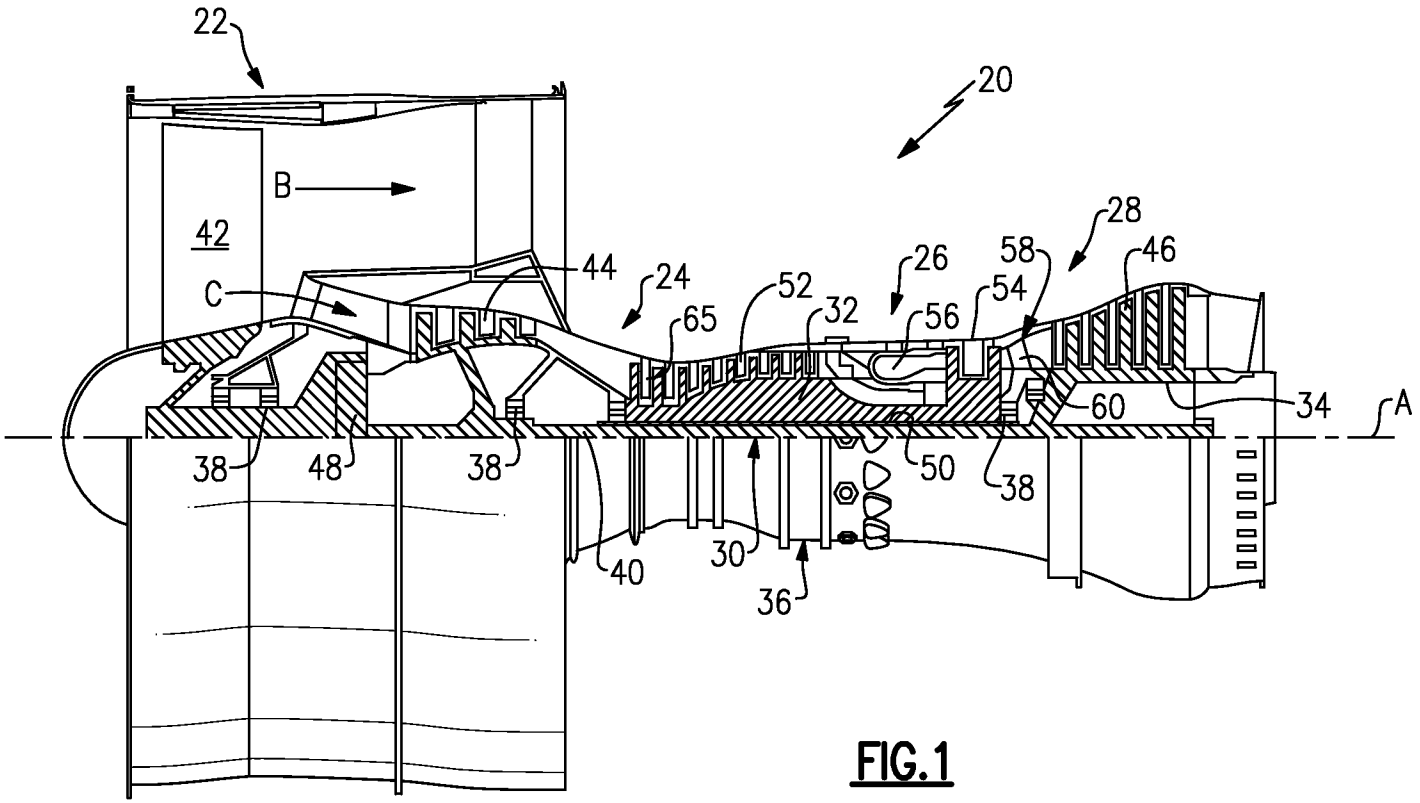
FIG. 1 schematically illustrates an example gas turbine engine.

FIG. 1 schematically illustrates an example gas turbine engine 20 that includes a fan section 22, a compressor section 24, a combustor section 26, and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow flowpath C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6:1), with an example embodiment being greater than about ten (10:1). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by air in the bypass flowpath B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment, the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed," as disclosed herein according to one non-limiting embodiment, is less than about 1150 ft/second.

The example gas turbine engine includes the fan 42 that comprises in one non-limiting embodiment less than about twenty-six (26) fan blades. In another non-limiting embodiment, the fan section 22 includes less than about twenty (20) fan blades. Moreover, in one disclosed embodiment the low pressure turbine 46 includes no more than about six (6) turbine rotors schematically indicated at 34. In another non-limiting example embodiment, the low pressure turbine 46 includes about three (3) turbine rotors. A ratio between the number of fan blades and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Referring to 2A-5, an example variable vane actuation system 62 includes a vane arm 64, an actuation ring 66, and a vane stem 68. Rotating the actuation ring 66 about the axis A (FIG. 1) moves the vane arm 64 to pivot the vane stem 68 of an associated variable vane 72.

A pin 74 is fixedly attached to an end 76 of the vane arm 64. In this example, the pin 74 is received within an aperture 78 and then swaged to hold the pin 74 relative to the vane arm 64. A collar 82 of the pin 74 may contact the vane arm 64 to ensure that the pin 74 is inserted to an appropriate depth prior to swaging.

The pin 74 is radially received within a sync ring bushing 86, which is received within a, typically metal, sleeve 84. The actuation (or sync) ring 66 holds the metal sleeve 84. The bushing 86 permits the pin 74 and vane arm 64 to rotate together relative to the actuation ring 66 and the metal sleeve 84.

The pin 74 and the vane arm 64 are installed into the bushing 86 by traveling along a radial path P. Limiting radial outward movement of the vane arm 64 prevents the pin 74 from backing out of the bushing 86.

An end 88 of the vane arm 64 includes features for easing assembly and ensuring a proper assembly to the vane stem 68. The end 88 is radially secured to the vane stem 68 and thus helps to prevent the pin 74 from moving radially outward and backing out of an installed position within the bushing 86.

The example vane arm 64 is used to manipulate inlet guide vanes 65 in the high pressure compressor section 52 of the engine 10. The disclosed vane arm 64 includes a claw feature 90 for maintaining a set orientation between the vane arm 64 and the vane stem 68.

The example vane stem 68 includes a rounded threaded rod end 92 extending from a base section 94. The rod end 92 and base section 94 extend along a rotational axis V of the vane stem 68. A diameter of the example base section 94 is greater than a diameter of the rod end 92.

The base section 94 of the vane stem 68 includes at least two flat areas 100. The flat areas 100 extend along the axis V and face outward away from the axis V.

The example claw feature 90 comprises opposing fingers 104*a* and 104*b* that fold downward from a top surface 106. The fingers 104*a* and 104*b* are spaced to provide an opening 108 that receives the base section 94 of the vane stem 68. The fingers 104*a* and 104*b* extend from a top surface 106 of the vane arm 64 and terminate at respective faces 110*a* and 110*b*.

The opening 108 radially receives the vane stem 68 such that the faces 110*a* and 110*b* interface with a respective one of the flat areas 100 on the base section 94. The faces 110*a* and 110*b* engage the opposing sides of the vane stem 68 to provide a first orientation feature that orients the vane arm 64 relative to the vane stem 68.

The example claw feature 90 has an interference fit with the opposing flat areas 100 on the base section 94 of the vane stem 68. That is, prior to assembly, the opening 108 size (or distance between the faces 110*a* and 110*b*) is less than a distance between the opposing flat areas 100. The interference fit helps to hold the claw feature 90 onto the vane stem 68.

As the fit is an interference fit, the distances between the faces 110*a* and 110*b* prior to fitting over the vane stem 68 is less than a distance between the faces 110*a* and 110*b* after the press-fitting. In some examples, the interference fit between the claw feature 90 and the vane stem 68 is 0.002 to 0.006 inches (0.05 to 0.15 millimeters).

The rod end 92 of the vane stem 68 includes a flat area 114 that is clocked approximately 90 degrees from the opposing flat areas 100. The rod end 92, in this example, thus has a D-shaped cross-sectional profile. The rod end 92 extends through an opening 116 in the top surface 106. The flat area 114 of the rod end 92 engages a corresponding flat side 118 provided in the opening 116 through top surface 106 of the vane arm 64. The interface between the flat area 114 and the flat side 118 of the opening 116 provides a second orientation feature that assures proper aligned attachment of the vane arm 64 to the vane stem 68.

A tab washer 122 is placed over the rod end 92 of the vane stem 68 that extends through the vane arm 64. The washer 122 includes a tab portion 126 that is then bent over edge 130 of the vane arm 64.

The washer 122 provides yet another orientation feature between the vane arm 64 and vane stem 68. The washer 122 also provides for retention of the vane arm 64 to the vane stem 68.

A locking nut 134 is then threaded onto rod end 92 of the vane stem 68 over the tab washer 122 to hold the vane stem 68 and vane arm 64 in the set orientation.

In this example, the vane arm 64 is able to move from an uninstalled position, where the vane arm 64 is not securable to the vane stem 68, to an installed position, wherein the vane arm 64 is securable to the vane stem 68, with a radial movement. That is, the example vane arm 64 can be moved radially from an uninstalled position to an installed position.

Figure 6:
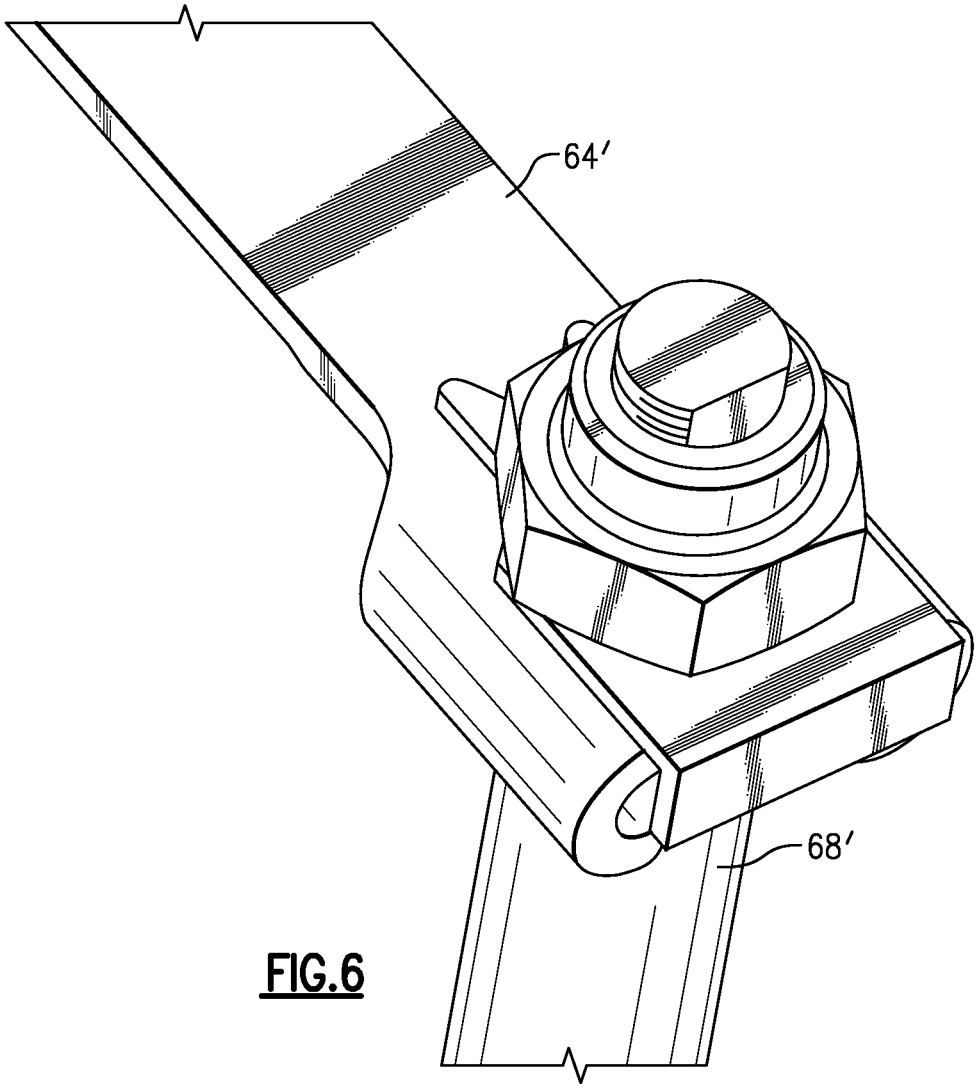
FIG. 6 illustrates a perspective view of a portion of another example vane actuation system.
Figure 7:
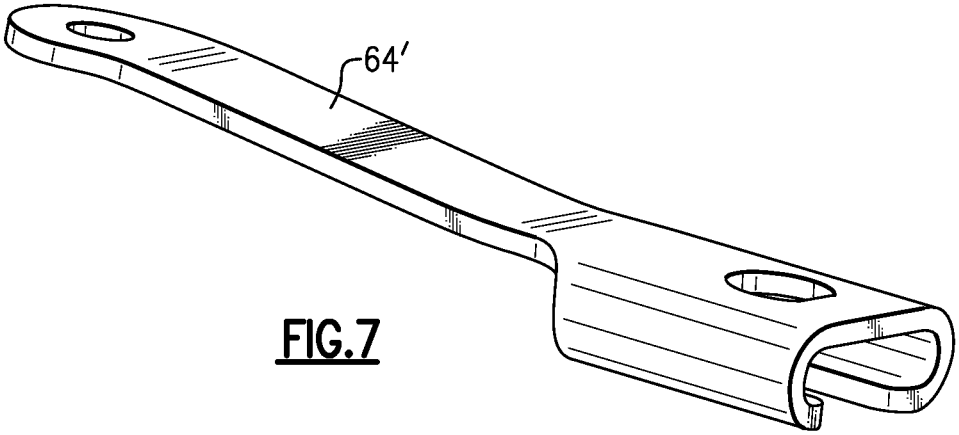
FIG. 7 illustrates a vane arm of the system of FIG. 6.

Referring to FIGS. 6 and 7, another example vane arm 64' is used to manipulate vanes in the first, second, and third stages of the high-pressure compressor 52, but utilizes substantially the same features as the vane arm 64 to secure the vane arm 64' to a vane stem 68' and actuation ring.

Figure 2A:
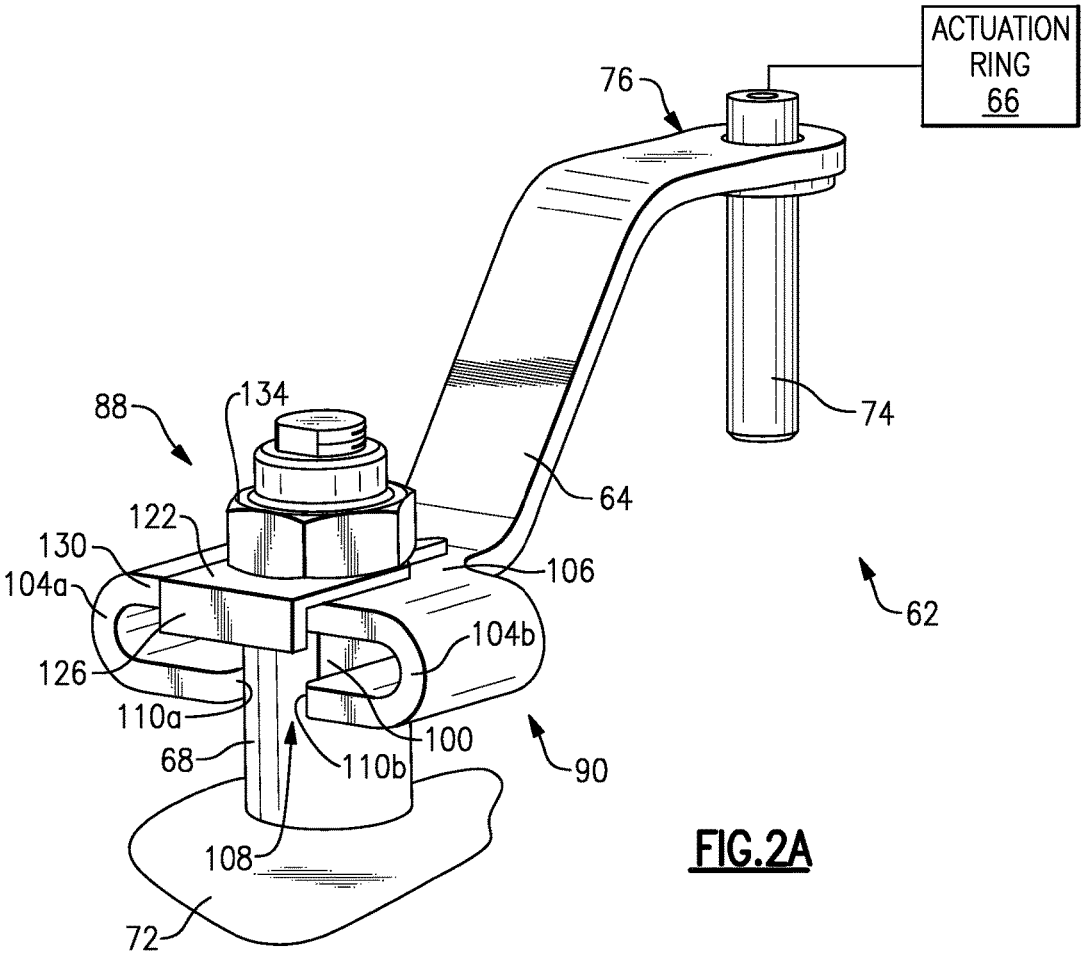
FIG. 2A illustrates a perspective view of a variable vane actuation system used within the engine of FIG. 1.
Figure 2B:
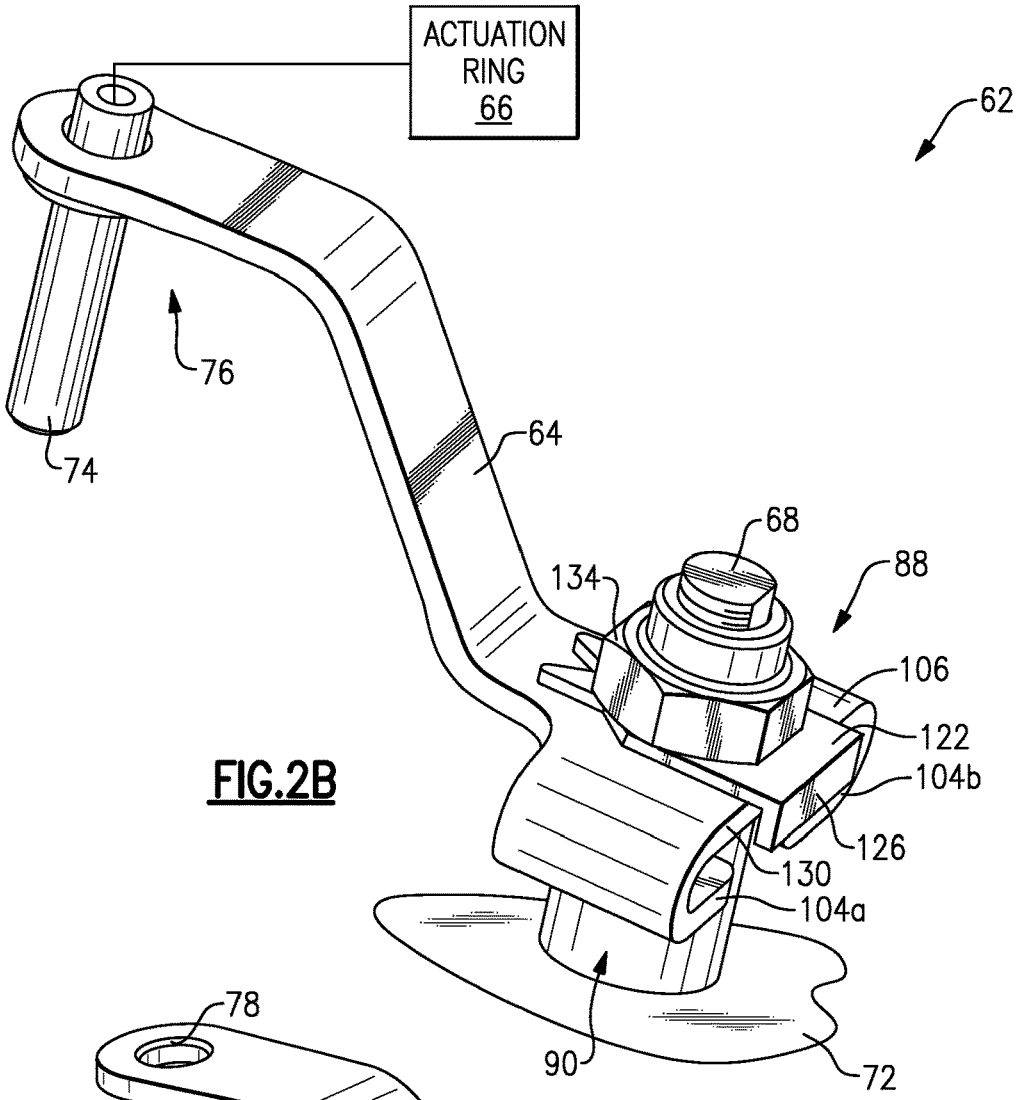
FIG. 2B illustrates another perspective view of the variable vane actuation system of FIG. 2A.
Figure 4:
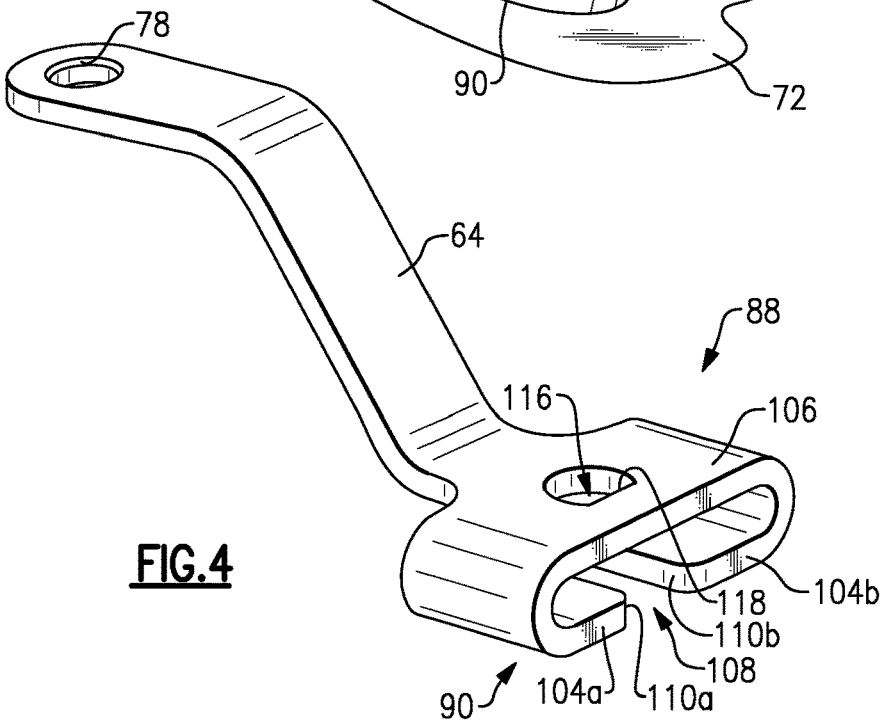
FIG. 4 illustrates a perspective view of a vane arm of the system of FIGS. 2A and 2B.
Figure 3:
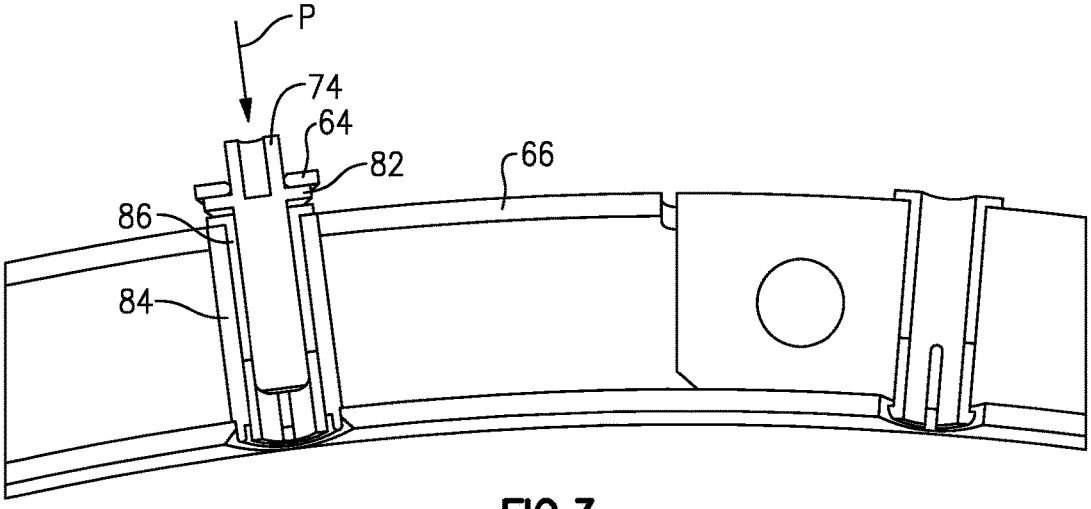
FIG. 3 illustrates a portion of an actuation ring of system of FIG. 1.
Figure 5:
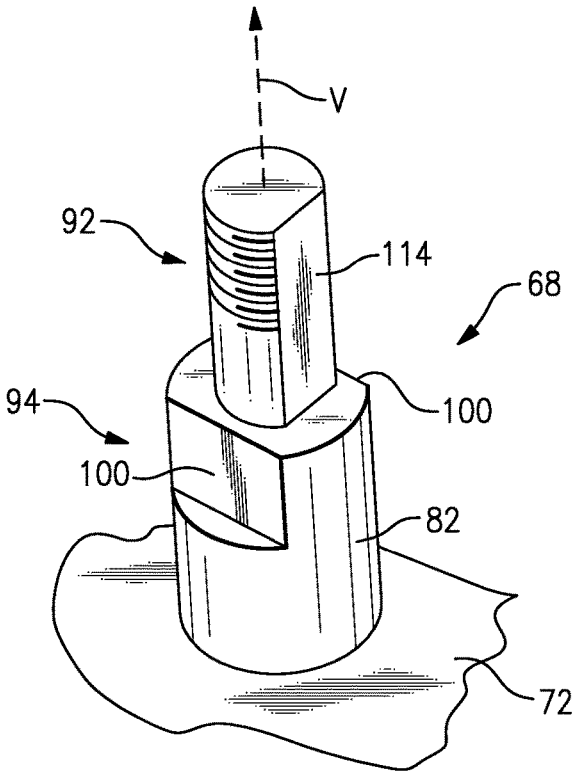
FIG. 5 illustrates a perspective view of a vane stem that is rotated using the system of FIGS. 2A and 2B.

The vane arm 64' is relatively planar when compared to the vane arm 64 of FIGS. 2 and 3. The example vane arms 64 and 64' are both constructed of sheet metal. The thickness of the vane arm 64' is greater than the thickness of the vane arm 64.

Features of the disclosed examples may include a vane stem attachment configuration that provides assembly mistake proofing features and allows for assembly in a radial direction. Moreover, the disclosed connection configuration provides three fastening mechanisms including the locking nut, the bent over tab of the tab washer and the press fit between the claw feature and sides of the vane stem.

Although one or more example embodiments have been disclosed, a worker of ordinary skill in this art would recognize that certain modifications would come within the scope of this disclosure. For that reason, the following claims should be studied to determine the scope and content of this disclosure.

We claim:

1. A variable vane actuation system for a gas turbine engine comprising:

a vane arm attachable to a vane stem of a vane and configured to rotate the vane stem about a radially extending axis, wherein the vane arm includes a claw feature to be press-fit onto the vane stem, wherein the claw feature includes opposing fingers extending away from a top surface toward the vane, the top surface including a surface opening extending completely through the top surface from a radially inward facing side of the top surface to a radially outward facing side of the top surface, the top surface having a flat side that is configured to interface with a flat area of the vane stem when the claw feature is press fit onto the vane stem.

2. The variable vane actuation system of claim 1, wherein the claw feature is to be press-fit radially onto the vane stem.

3. The variable vane actuation system of claim 1, wherein the surface opening in the surface comprises a D-shaped opening corresponding with a D-shaped portion of the vane stem.

4. The variable vane actuation system of claim 3, further comprising a tab washer assembled onto the D-shaped portion of the vane stem and configured to bend over an end of the vane arm.

5. The variable vane actuation system of claim 4, further comprising a threaded lock nut attached to the D-shaped portion of the vane stem to hold the vane arm to the vane stem.

6. The variable vane actuation system of claim 3, wherein the D-shaped portion is threaded.

7. The variable vane actuation system of claim 1, wherein the claw feature has an interference fit to the vane stem that is from 0.002 inches to 0.006 inches.

8. The variable vane actuation system of claim 1, wherein the opposing fingers each terminate at respective faces spaced from each other to define a claw opening that receives the vane stem, the faces configured to interface directly with opposing sides of the vane stem, wherein the claw opening is radially spaced from the surface opening.

9. The variable vane actuation system of claim 8, wherein a distance between the faces prior to receiving the vane stem is less than a distance between the faces after receiving the vane stem.

10. The variable vane actuation system of claim 1, wherein a portion of the vane stem extends radially though the surface opening.

11. The variable vane actuation system of claim 1, further comprising a pin to couple an end of the vane arm to an actuation ring, the end opposite the claw feature, wherein the pin is assembled radially to the actuation ring.

12. The variable vane actuation system of claim 11, wherein attachment of the claw feature to the vane stem limits radially outward movement of the pin.

13. A method of assembling a variable vane actuation system, comprising:

press-fitting a claw feature of a vane arm onto a vane stem extending radially from a vane of a vane assembly while a portion of the vane stem extends through a surface opening in the vane arm, the surface opening radially spaced from the claw feature such that the claw feature extends radially closer to the vane than the surface opening does, wherein the vane assembly is a continuous structure having both the vane stem and the vane, wherein the claw feature includes fingers terminating at faces spaced from each other to define a claw opening that receives the vane stem after the press-fitting.

14. The method of claim 13, further comprising press-fitting the claw feature radially on the vane stem by moving the claw feature in a radial direction from a position radially outside a flat area of the vane arm to a position radially aligned with the flat area, wherein the surface opening extends completely through the vane arm from a radially inward facing side of the vane arm to a radially outward facing side of the vane arm.

15. The method of claim 13, wherein a distance between the faces prior to the press-fitting is less than a distance between the faces after the press-fitting, wherein the claw opening is radially spaced from the surface opening.

16. The method of claim 13, further comprising moving an end of the vane arm radially to move the end between an uncoupled position with an actuation ring and a coupled position with the actuation ring, the end opposite the claw feature.

17. The method of claim 16, further comprising limiting radial outward movement of the end from the coupled position to the uncoupled position using, exclusively, attachment of the claw feature to the vane stem.

18. The method of claim 13, wherein the surface opening in the surface is a D-shaped opening corresponding with a D-shaped portion of the vane stem.

19. A method of coupling a vane arm within a gas turbine engine, comprising:

moving a vane arm radially from an uninstalled position to an installed position within a gas turbine engine;

receiving a portion of a vane stem within an aperture of the vane arm during the moving, the aperture extending through the vane arm and opening to both a radially inward facing surface and a radially outward facing surface of the vane arm, the vane stem extending radially from a vane of a vane assembly prior to the receiving, the vane assembly a continuous structure having both the vane and the vane stem, the aperture of the vane arm radially spaced from an opening between opposing fingers of a claw portion of the vane arm such that the aperture is radially outside the opening between the opposing fingers; and press-fitting the claw portion of the vane arm over the vane stem during the moving.

* * * * *